US005773402A

United States Patent [19]

D'Orazio

[11] Patent Number: 5,773,402

[45] Date of Patent: Jun. 30, 1998

[54] HYPOCHLORITE-COMPRISING COMPOSITIONS FOR IMPROVED MILDNESS TO THE SKIN

[76] Inventor: Anna Lucia D'Orazio, Procter & Gamble Italia S.p.A. Via Cesare Pavese 385, I-00144 Roma, Italy

[21] Appl. No.: 617,774

[22] PCT Filed: Sep. 12, 1994

[86] PCT No.: PCT/US94/10247

§ 371 Date: Sep. 11, 1996

§ 102(e) Date: Sep. 11, 1996

[87] PCT Pub. No.: WO95/08612

PCT Pub. Date: Mar. 30, 1995

[30] Foreign Application Priority Data

Sep. 20, 1993 [EP] European Pat. Off. ..... 9381093

[51] Int. Cl.[6] ..... C11D 3/395; C11D 1/83

[52] U.S. Cl. ..... 510/380; 510/373; 510/430; 510/433; 252/187.24; 252/187.26

[58] Field of Search ..... 252/187.24, 187.26; 510/303, 373, 380, 426, 427, 428, 429, 430, 433

[56] References Cited

U.S. PATENT DOCUMENTS

| | | | |
|---|---|---|---|
| 4,282,109 | 8/1981 | Citrone et al. | 510/373 |
| 4,789,495 | 12/1988 | Cahall et al. | 510/373 |
| 5,227,366 | 7/1993 | Swatling et al. | 512/2 |
| 5,531,915 | 7/1996 | Perkins | 510/294 |

*Primary Examiner*—Paul Lieberman
*Assistant Examiner*—Caroline L. Dusheck
*Attorney, Agent, or Firm*—Richard S. Echler, Sr.; K. W. Zerby; B. M. Bolam

[57] ABSTRACT

Hypochlorite-comprising cleaning compositions which have improved mildness to the skin which comprise a combination of an amine-oxide and an alkyl sulfate surfactant. The hypochlorite-containing compositions also contain a fatty acid, and may contain additional ingredients including additional detersive surfactants. The compositions preferably have a pH of at least about 12.

6 Claims, No Drawings

HYPOCHLORITE-COMPRISING COMPOSITIONS FOR IMPROVED MILDNESS TO THE SKIN

FIELD OF THE INVENTION

The present invention is related to hypochlorite-based compositions.

BACKGROUND OF THE INVENTION

The present invention relates to hypochlorite-comprising compositions. It is highly desirable to incorporate hypochlorite in detergent compositions for bleaching. However, hypochlorite is an irritant and many consumers suffer from skin irritation when using such compositions.

Particularly, the hands of the user are prone to such irritation. As a result of coming into contact with such compositions the hands suffer from dryness and from a feeling of tightness. This occurs when the compositions are used neat and also when used in diluted form.

It is believed that hypochlorite attacks the uppermost layer of the epidermal of the skin. This results in the decrease of the elasticity of the skin. The skin also becomes more sensitive, resulting in dryness and coarseness of the skin. In addition the skin may become inflamed and become red and sore and itchy. These effects are magnified in alkaline conditions, because alkali is also an irritant. Alkalinity is required for hypochlorite stability and it thus the preferred condition for hypochlorite-comprising compositions. However, alkaline conditions contribute to skin tightening because it alters the natural pH of the skin.

The object of the present invention is to improve skin mildness and reduce skin irritation of hypochlorite-comprising compositions.

The present invention overcomes these problems by the use of the combination of amine oxides and specific alkyl sulphates in hypochlorite-comprising compositions. It is believed that this surfactant combination wets the skin and provides a protective layer against hypochlorite and alkalinity on the skin.

Amine oxides and alkyl sulphates are known in the art. U.S. Pat. No. 4,282,109 discloses a thickened bleach composition comprising hypochlorite and a thickening amount of a surfactant blend, comprising amine oxide $C_{10}$–$C_{18}$ and alkyl sulphate $C_8$–$C_{12}$. There is no mention of the reduction of hypochlorite related skin irritation of these compositions.

EP 274 885 discloses thickened bleaching compositions comprising alkali metal hypochlorite and straight chain $C_{14}$ amine oxide with a mixture of branched and straight chain $C_{15}$ amine oxide. There is no mention of short chain surfactants or the reduction of hypochlorite related skin irritation.

EP 233 666 discloses a process for the manufacture of a thickened bleaching compositions comprising hypochlorite, a hypochlorite-soluble surfactant, including amine oxide and an alkali metal salt of a fatty acid. There is no mention of the reduction of hypochlorite related skin irritation.

DE 28 37 880 covers bleaching compositions comprising alkali metal hypochlorite and mixtures of branched and linear amine oxides of varying chain length, ($C_5$–$C_{17}$) for increased viscosity. There is no mention of other long or short chain surfactants or the reduction of hypochlorite skin irritation.

EP 30 401 covers thickened bleaching compositions comprising hypochlorite and a certain number of product characteristics including pH and viscosity. Mixtures of $C_8$–$C_{18}$ amine oxides and fatty acids are preferred as thickening agents. No other surfactants are disclosed. There is also no mention of reducing the irritation effects due to the hypochlorite.

Co-pending European application Nos. 93202187.6 and 93202186.8 disclose short chain surfactants.

SUMMARY OF THE INVENTION

The present invention is the use of the combination of an amine oxide with an alkyl sulphate in hypochlorite-comprising compositions for improved skin mildness. Said amine oxide is according to the formula $R_1R_2R_3NO$, wherein $R_1$ is a $C_8$ to $C_{18}$ alkyl group and $R_2$ and $R_3$ are independently $C_1$ to $C_3$ alkyl groups. Said alkyl sulphate is according to the formula $R_4OSO_3H$, wherein $R_4$ is a $C_6$ to $C_{10}$ alkyl group.

All amounts, ratios, percentages and parts herein are given as a % weight of the total composition unless otherwise stated.

DETAILED DESCRIPTION OF THE INVENTION

The present invention is the use of the combination of an amine oxide and an alkyl sulphate in hypochlorite-comprising compositions for improved skin mildness.

Thus, an essential ingredient in the present invention is hypochlorite. Preferably the hypochlorite is an alkali metal hypochlorite. Although alkali metal hypochlorites are preferred other hypochlorite compounds may also be used herein and can be selected from calcium and magnesium hypochlorite. According to the present invention the compositions comprise said hypochlorite compound such that the content of active chlorine in the composition is from 0.4% to 5%, preferably from 1% to 4%, most preferably from 1% to 3%.

Another essential ingredient is a combination of an amine oxide with an alkyl sulphate to improve skin mildness of the composition. Said amine oxide is according to the formula $R_1R_2R_3NO$, wherein $R_1$ is a $C_8$ to $C_{18}$ alkyl group and $R_2$ and $R_3$ are independently $C_1$ to $C_3$ alkyl groups. Preferably $R_1$ is a $C_{10}$–$C_{18}$, more preferably $C_{12}$–$C_{18}$ alkyl group and $R_2$ and $R_3$ are preferably independently $C_1$–$C_3$, more preferably $C_1$–$C_2$ alkyl groups. In the present invention the composition comprises from 1% to 5%, more preferably from 1.5% to 4.5%, most preferably from 2% to 4% of said amine oxide and mixtures thereof.

Said alkyl sulphate is according to the formula $R_4OSO_3H$, wherein $R_4$ is a $C_6$ to $C_{10}$, preferably a $C_7$–$C_9$, more preferably a $C_8$ alkyl group. According to the present invention the composition comprises from 1% to 8%, more preferably from 1.5% to 7.5%, most preferably from 2% to 7% of said alkyl sulphate and mixtures thereof.

According to the present invention the compositions may further comprise a number of additional ingredients. Suitable optional ingredients include other hypochlorite-compatible long chain surface actives including alkyl sarcosinates, alkyl ether sulphates, paraffin sulphonates and amine oxides.

Another optional component of the present invention is an alkali metal salt of a $C_8$–$C_{18}$ fatty acid. Suitable fatty acids for use herein can be any $C_8$–$C_{18}$ fatty acid, preferably fully saturated, preferably a sodium, potassium or lithium salt, more preferably the sodium salt.

In a highly preferred embodiment of the present invention the compositions have a pH greater than 10, preferably greater than 11, more preferably greater than 12. This is achieved by the addition of from 0.8% to 1.5% of a caustic alkali. Suitable caustic alkalis for use herein include sodium and potassium hydroxide.

According to the present invention the composition may also comprise a number of other additional ingredients such as hypochlorite stable and soluble colourants, perfumes and hydrotopes such as sodium xylene sulphonate.

According to the present invention the compositions are prepared by methods known in the art such as those described in GB 1 329 086.

According to the present invention the compositons may be used for a variety of purposes, such as bleaching and hard surfaces cleaning.

According to the present invention the compositions can be illustrated by the following examples.

EXAMPLES

| EXAMPLE<br>% weight | 1<br>% | 2<br>% | 3<br>% | 4<br>% | 5<br>% |
|---|---|---|---|---|---|
| Ingredients: | | | | | |
| Coconut dimethyl amine oxide | 0.6 | 0.8 | 1 | 0.6 | 0.6 |
| Tetra decyldimethyl amine oxide** | 3 | 3 | 3 | 4 | 2 |
| Octyl alkyl sulphate | 3 | 3 | 3 | 4 | 3 |
| Coconut fatty acid*** | 0.9 | 0.5 | 0.5 | 0.5 | |
| Sodium hypochlorite | 1.7 | 1.4 | 1.4 | 1.4 | 1.7 |
| Sodium hydroxide | 1 | 1 | 1 | 1 | 1.3 |
| Silicate | 0.4 | 0.04 | 0.04 | 0.04 | 0.4 |
| Perfume mixture | 0.3 | 0.3 | 0.3 | — | — |
| Minors | | | | | |
| Viscosity (cps at. 25° C. | 300 | 420 | 500 | 1000 | 25 |
| pH | 13 | 13 | 13 | 13 | 13 |

| EXAMPLE<br>% weight | 6<br>% | 7<br>% | 8<br>% | 9<br>% | 10<br>% |
|---|---|---|---|---|---|
| Ingredients: | | | | | |
| Coconut dimethyl amine oxide | 0.6 | 0.6 | 0.6 | 0.6 | 0.6 |
| Tetra decyldimethyl amine oxide** | 2 | 1 | — | 4 | 4 |
| Octyl alkyl sulphate | 2 | 1 | 1 | 4 | 5 |
| Coconut fatty acid*** | 0.9 | 0.9 | 0.5 | 0.5 | |
| Sodium hypochlorite | 1.4 | 1.4 | 1.4 | 1.4 | 2 |
| Sodium hydroxide | 1.1 | 1.1 | 1.1 | 1.1 | 1.3 |
| Silicate | 0.4 | 0.4 | 0.4 | 0.4 | 0.4 |
| Perfume mixture | 0.25 | 0.25 | 0.25 | 0.3 | 0.25 |
| Minors | | | | | |
| Viscosity (cps at 25° C. | 280 | 200 | 20 | 500 | 30 |
| pH | 13 | 13 | 13 | 13 | 13 |

| EXAMPLE<br>% weight | 11<br>% | 12<br>% | 13<br>% | 14<br>% |
|---|---|---|---|---|
| Ingredients | | | | |
| Coconut dimethyl amine oxide | 1 | 1 | 1 | 1 |
| Tetra decyldimethyl amine oxide** | 2 | 2 | 2 | 2 |
| Octyl alkyl sulphate | 4 | 5 | 6 | 7 |
| Coconut fatty acid*** | | | | |
| Sodium hypochlorite | 1.7 | 1.7 | 1.7 | 1.7 |
| Sodium hydroxide | 1 | 1 | 1 | 1 |
| Silicate | 0.04 | 0.04 | 0.04 | 0.04 |
| Perfume mixture | 0.3 | 0.3 | 0.3 | 0.3 |
| Minors | | | | |
| Viscosity (cps at 25° C. | 15 | 15 | 15 | 15 |
| pH | 13 | 13 | 13 | 13 |

* Hoechst raw material containing the following chain length distribution: C10 and lower 2% max, C12 62%–75%, C14 21%–30%, C16 C18 8% maximum.

** Akzo raw material containing the following chain length distribution: C12 2%, C14 97%, C16 1%.

***Unichema raw material containing the following chain length distribution: C8–C10 1.5%, C12 53%, C14 24%, C16 14%, C18 7.5%.

I claim:

1. A cleaning composition having reduced skin irritation, comprising:

a) a hypochlorite compound wherein the amount of active chlorine is from about 0.4% to about 5% of the composition;

b) from 2% to about 5% of an amine oxide having the formula:

$$R_1R_2R_3NO$$

wherein $R_1$ is $C_8$–$C_{18}$ alkyl; $R_2$ and $R_3$ are each independently $C_1$–$C_3$ alkyl;

c) from about 1% to about 8% of an alkyl sulfate having the formula:

$$R_4OSO_3H$$

wherein $R_4$ is $C_6$–$C_{10}$ alkyl;

d) from about 0.5% to about 0.9% of an alkali metal salt of a $C_8$–$C_{18}$ fatty acid;

and e) the balance carriers and adjunct ingredients.

2. A composition according to claim 1 wherein $R_1$ is $C_{10}$–$C_{12}$ alkyl, $R_2$ and $R_3$ are each methyl.

3. A composition according to claim 1 wherein $R_4$ is $C_7$–$C_9$ alkyl.

4. A composition according to claim 1 wherein said hypochlorite compound is sodium hypochlorite.

5. A composition according to claim 1 wherein the pH of said composition is at least about 12.

6. A composition according to claim 1 further comprising detersive surfactants, said surfactants are selected from the group consisting of alkyl sarcosinates, alkyl ether sulphates, paraffin sulphonates, and mixtures thereof.

* * * * *